US005782644A

United States Patent [19]

Kiat

[11] Patent Number: 5,782,644

[45] Date of Patent: Jul. 21, 1998

[54] PRINTED CIRCUIT BOARD MOUNTED ELECTRICAL CONNECTOR

[75] Inventor: Toh Ser Kiat, Singapore, Singapore

[73] Assignee: Molex Incorporated, Lisle, Ill.

[21] Appl. No.: 757,496

[22] Filed: Nov. 27, 1996

Related U.S. Application Data

[63] Continuation of Ser. No. 381,614, Jan. 30, 1995, Pat. No. 5,584,709.

[51] Int. Cl.[6] ..... H01R 9/09

[52] U.S. Cl. ..... 439/79

[58] Field of Search ..... 439/79, 80, 62

[56] References Cited

U.S. PATENT DOCUMENTS

| | | | |
|---|---|---|---|
| 4,652,066 | 3/1987 | Pelzl et al. | 439/17 |
| 4,653,837 | 3/1987 | Phillipson et al. | 439/143 R |
| 4,687,267 | 8/1987 | Header et al. | 439/62 |
| 4,722,691 | 2/1988 | Gladd et al. | 439/79 |
| 4,840,573 | 6/1989 | Seidel et al. | 439/92 |
| 5,066,236 | 11/1991 | Broeksteeg | 439/79 |
| 5,104,341 | 4/1992 | Gilissen et al. | 439/79 |
| 5,112,233 | 5/1992 | Lybrane | 439/79 |
| 5,199,886 | 4/1993 | Patterson | 439/79 |
| 5,281,165 | 1/1994 | McCleerey et al. | 439/510 |
| 5,286,212 | 2/1994 | Broeksteeg | 439/108 |
| 5,539,978 | 7/1996 | Vanbesien | 439/885 |

FOREIGN PATENT DOCUMENTS

| | | | |
|---|---|---|---|
| 88 11 877.0 | 12/1988 | Germany | H01R 9/09 |

*Primary Examiner*—Gary F. Paumen
*Assistant Examiner*—T C Patel
*Attorney, Agent, or Firm*—Charles S. Cohen

[57] ABSTRACT

An electrical connector includes an elongated dielectric housing adapted for mounting to a surface of a printed circuit board. The housing has terminal-receiving passages extending generally parallel to the circuit board between a front mating face of the housing and a rear terminating face thereof. The passages are arranged in pairs of upper and lower passages, with the passages in each pair being in a plane generally perpendicular to the circuit board. A plurality of terminals are mounted in pairs on the housing with mating portions in the passages and terminating portions projecting from the rear face of the housing for termination to circuit traces on the printed circuit board. The terminals are blanked from sheet metal material with the terminals in each pair being coplanar. The terminating portions have generally inverted U-shaped configurations, with the U-shaped terminating portion of a lower terminal in each pair thereof being nested within the U-shaped terminating portion of an upper terminal in each pair thereof.

34 Claims, 3 Drawing Sheets

PRINTED CIRCUIT BOARD MOUNTED ELECTRICAL CONNECTOR

This is a continuation of application(s) Ser. No. 08/381,614 filed on Jan. 30, 1995, now U.S. Pat. No. 5,584,709.

FIELD OF THE INVENTION

This invention generally relates to the art of electrical connectors and, particularly, to an electrical connector for mounting to a printed circuit board.

BACKGROUND OF THE INVENTION

A wide variety of electrical connectors are designed for mounting to printed circuit boards. Such connectors conventionally include a dielectric housing, such as a unitarily molded plastic housing, adapted for mounting to one side of the board. The housing typically includes a front mating face for mating with a complementary connecting device and a rear terminating face from which a plurality of terminals exit the housing for termination to circuit traces on the printed circuit board. The terminals normally include mating portions for mating with the terminals of the complementary connecting device, and terminating or tail portions projecting from the housing for interconnection, as by soldering, to circuit traces on the board or in holes in the board into which the tails are inserted.

Some printed circuit board mounted electrical connectors are designed for mounting at an edge of the board. The connector housing has a mounting portion for mounting to a top surface of the board to define a seating plane for the connector. For instance, the main body portion of the connector housing may run along the edge of the board, with mounting ear portions of the housing projecting from the terminating face thereof for mounting the top surface of the board. The tail portions of the terminals project from the housing, such as between the mounting ears projecting therefrom, for termination to the circuit. traces on the board.

Problems continue to arise in designing electrical connectors of the character described above. These problems often are associated with the design and/or assembly of the terminals in the connector housing. For instance, difficulties arise in inserting the terminals into the connector housing because of the delicate nature of the tail portions of the terminals projecting from the rear terminating face of the housing. These tail portions may be very thin elements and insertion forces would tend to bend or break the tail portions. Therefore, many such electrical connectors employ stamped and formed terminals which are formed with various portions to facilitate insertion of the terminals into the connector housing. On the other hand, it would be desirable to be able to simply blank the terminals from sheet metal material, but blanked terminals heretofore designed do not facilitate efficient insertion of the terminals into the connector housing.

In addition, simple blanked terminals have a tendency to be relatively wasteful in the amount of sheet metal material required in the blanking process. The design of the terminals result in a considerable amount of sheet metal material going to waste after the terminals are fabricated.

Still further, the configuration of the terminating/tail portions of the terminals which project from the housing for interconnection to circuit traces on the printed circuit board, have not been amenable to high density arrays. The terminating or tail portions of the terminals simply require too much space at the rear face of the connector housing.

The present invention is directed to solving the various problems identified above and satisfying a need for a printed circuit board mounted electrical connector having an extremely compact terminal array which facilitates insertion of the terminals into the connector, the terminals being blanked of sheet metal material in a very efficient, nonwasteful configuration.

SUMMARY OF THE INVENTION

An object, therefore, of the invention is to provide a new and improved circuit board mounted electrical connector of the character described above.

In the exemplary embodiment of the invention, the electrical connector includes an elongated dielectric housing adapted for mounting along an edge of a printed circuit board with a mounting portion of the housing being mounted to a top surface of the board to define a seating plane for the connector. The housing has terminal-receiving passages extending generally parallel to the seating plane between a front mating face of the housing and a rear terminating face thereof. The passages are arranged in pairs of upper and lower passages longitudinally along at least a portion of the housing. The passages in each pair are in a plane perpendicular to the seating plane.

A plurality of terminals are mounted in pairs on the housing, with mating portions in the passages and terminating portions projecting from the rear face of the housing for termination to circuit traces on the printed circuit board. The terminals are blanked from sheet metal material, with the terminals in each pair being coplanar. The terminating portions have generally inverted U-shaped configurations, with the U-shaped terminating portion of a lower terminal in each pair thereof being nested within the U-shaped terminating portion of an upper terminal in each pair thereof.

The mounting portion of the housing may be located at a position for effectively locating the seating plane of the connector above the centerline of the lower passages in the pairs thereof.

The U-shaped terminating portions of the terminals define an inner leg, an outer leg and a bridge portion of each terminating portion of each terminal. In the preferred embodiment of the invention, the inner legs are located in a recessed area in the rear terminating face of the housing. A shoulder is formed on the underside of each bridge portion of each upper terminal to facilitate insertion of the terminals into their respective passages. The outer legs form solder tails, with the tips of the solder tails being located in proximity to a plane defined by the bottom edge of the lower terminal.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
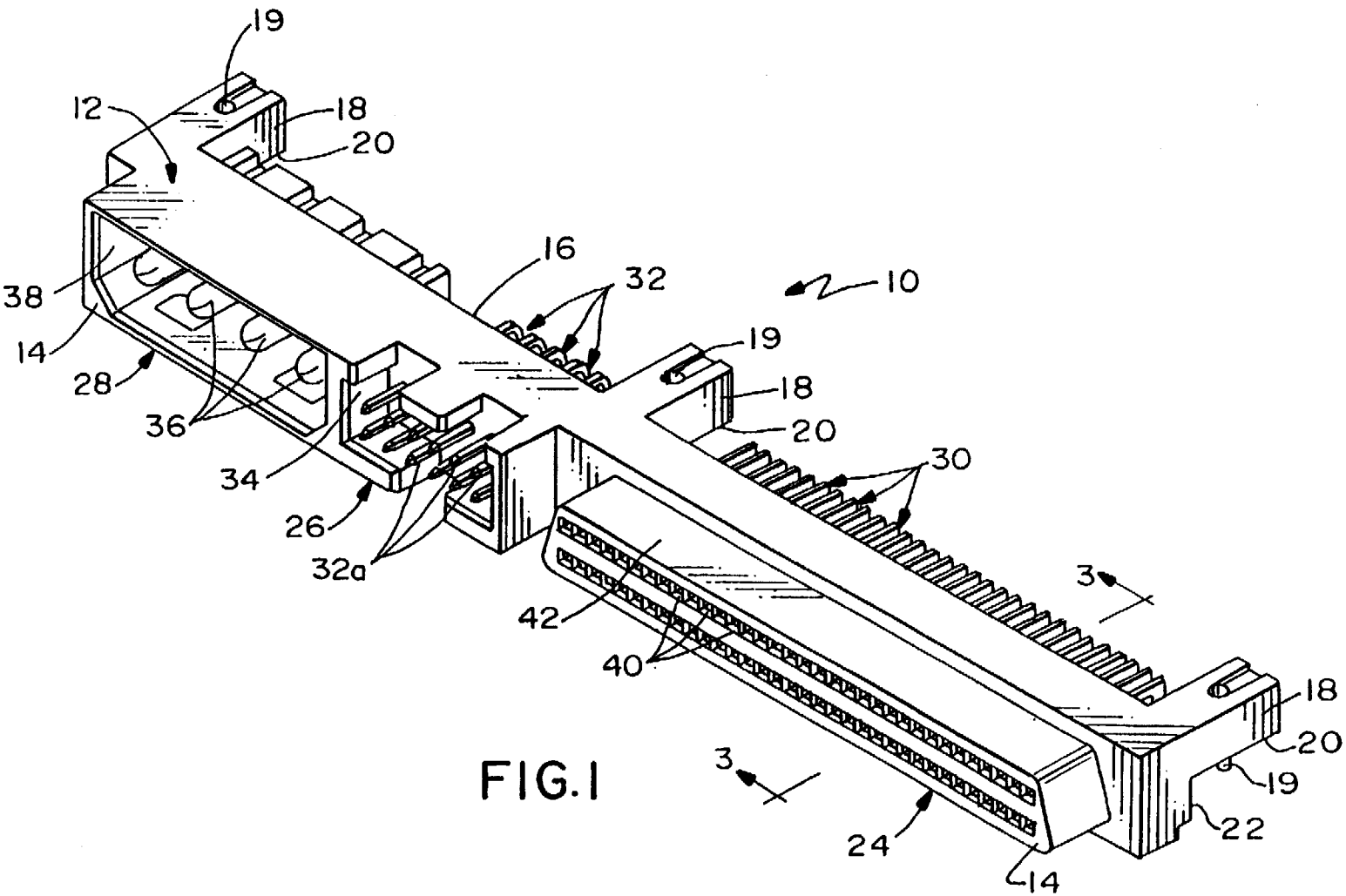
FIG. 1 is a perspective view of an electrical connector embodying the concepts of the invention.

Referring to the drawings in greater detail, and first to FIG. 1, the invention is embodied in an electrical connector, generally designated 10, which includes an elongated dielectric housing, generally designated 12, adapted for mounting along an edge of a printed circuit board, as will be seen hereinafter. Housing 12 includes a front mating face 14 and a rear terminating face 16 and three mounting ears 18 project rearwardly of the terminating face for mounting to a top surface of the printed circuit board. Pins 19 project through ears 18 and into appropriate holes in the printed circuit board. Bottom surfaces 20 of mounting ears 18 engage the top surface of the board. In addition, connector 10 is adapted for mounting along an edge 44c (FIG. 3) of the printed circuit board. To that end, housing 12 includes a rear surface 22 for engaging the edge of the board. The rear surface 22 is coplanar with rear face 16. The housing is unitarily molded of dielectric material such as plastic or the like.

At this point, it should be understood that such terms as "top", "bottom", "upper" and "lower" are used herein to provide a clear and concise description of the invention as viewed in the drawings. However, the use of such terms herein and in the claims hereof are not intended in any way to be limiting, because it is known that printed circuit board mounted electrical connectors, as well as the printed circuit boards themselves, are omni directional in actual practice or use.

Still referring to FIG. 1, electrical connector 10 is a combination connector which includes three sections spaced lengthwise of the connector and generally designated 24, 26 and 28. Section 24 will be termed the data section of the connector and includes a plurality of terminals 30 embodying the concepts of the invention. Section 26 will be termed the options section of the connector and includes a plurality of right-angled terminals 32 having pin portions 32a disposed in a center recessed area 34 in mating face 14 of housing 12 for mating with terminals of a complementary connecting device or mating connector (not shown). Section 28 will be termed the power section of the connector and includes four large formed terminals 36 located in an end recessed area 38 in mating face 14 of housing 12 for mating with the power terminals of the complementary mating connector. As will be described below, terminals 30 of data section 24 have mating portions (not visible in FIG. 1) extending into terminal-receiving passages 40 in a "D-shaped" projecting portion 42 of housing 12 for insertion into a complementary D-shaped receptacle of the complementary connecting device.

Figure 2:
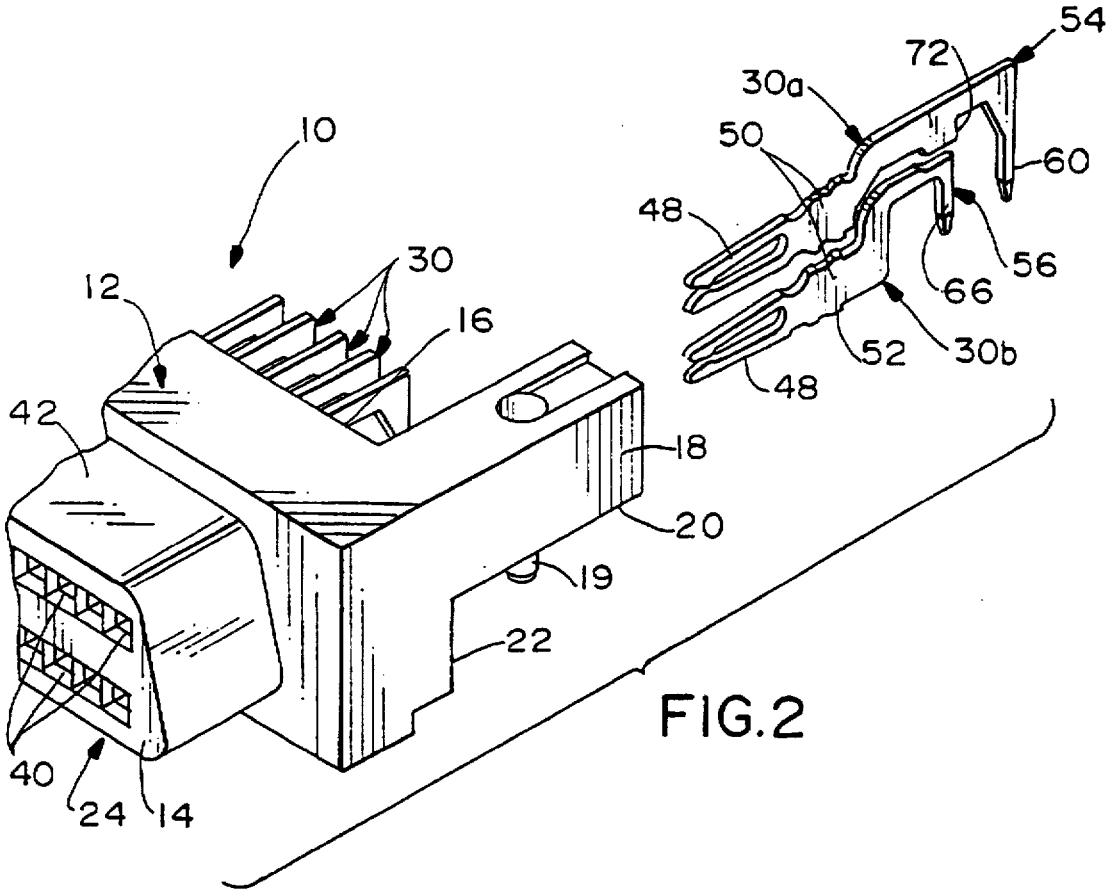
FIG. 2 is an enlarged perspective view of the right-hand end of the connector shown in FIG. 1, with a pair of the terminals removed to facilitate an illustration, thereof.

Referring to FIG. 2 and as described in greater detail hereinafter, terminals 30 in data section 24 of connector 10 are arranged in pairs of upper and lower terminals, generally designated 30a and 30b, respectively, longitudinally along connector housing 12. One pair of the terminals 30a and 30b are removed from the housing in FIG. 2 to facilitate the illustration thereof. It can be seen quite clearly in FIG. 2 that the terminals are blanked terminals, i.e., blanked from sheet metal material rather than stamped and then formed into a shape out of the plane of the sheet metal material. The terminals in each pair also are quite clearly seen to be coplanar and are in that relationship when inserted into connector housing 12.

Figure 3:
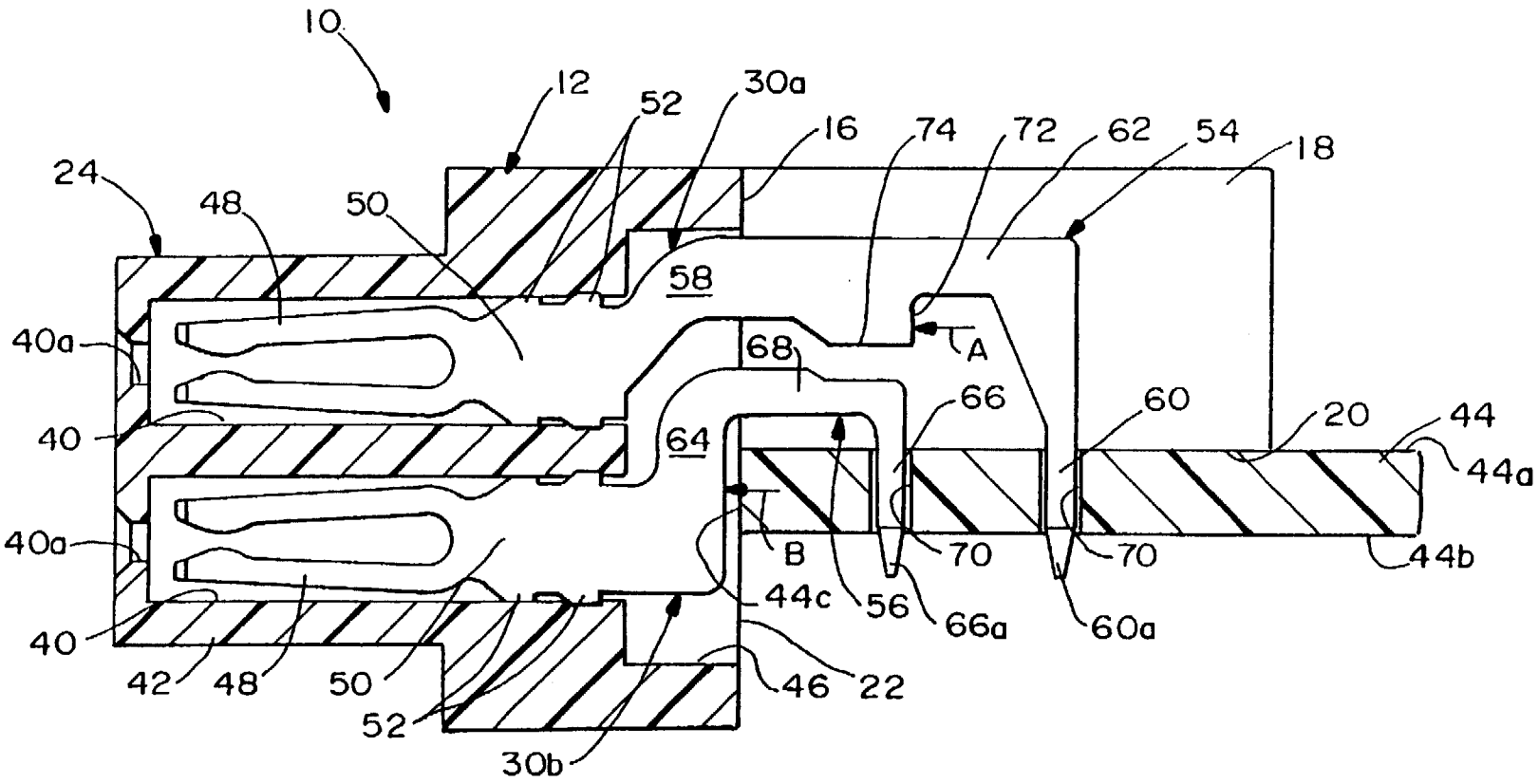
FIG. 3 is a vertical section, on an enlarged scale, taken generally along line 3—3 of FIG. 1.

Referring to FIG. 3 in conjunction with FIGS. 1 and 2, connector 10 is shown to be mounted to a printed circuit board 44 having a top surface 44a and a bottom surface 44b. The bottom surface 20 of mounting ears 18 are shown engaged with top surface 44a of the printed circuit board, while rear surface 22 (i.e., rear terminating face 16) of connector housing 12 is in edge engagement or with an edge 44c of the printed circuit board. Bottom surface 20 of mounting ears 18 define the "seating plane" of connector 10 on circuit board 44. Terminal-receiving passages 40 can be seen clearly in FIG. 3 to extend generally parallel to the seating plane, with the passages extending between the front mating face and the rear terminating face of connector housing 12. Actually, the passages have front entry areas 40a of reduced size for receiving mating terminal pins of the complementary mating connector. The passages open into a recessed area 46 in terminating face 16 of the connector housing. Finally, passages 40 are arranged in pairs of upper and lower passages extending longitudinally along data section 24 of the connector, with the passages in each pair being in a plane perpendicular to the seating plane defined by bottom surface 20 of mounting ears 18.

Upper and lower terminals 30a and 30b, respectively, have substantially identical bifurcated mating portions 48 projecting from body portions 50 within their respective passages 40 toward entry areas 40a for mating with the terminal pins of the complementary mating connector. Body portions 50 of the terminals have barbs 52 for press fitting into the plastic material of housing 12 within passages 40.

Generally, upper and lower terminals 30a and 30b, respectively, have terminating portions 54 and 56, respectively, which have generally inverted U-shaped configurations. It can be seen in both FIGS. 2 and 3 that the U-shaped terminating portion 56 of lower terminal 30b is nested within the U-shaped terminating portion 54 of upper terminal 30a.

U-shaped terminating portion 54 of upper terminal 30a defines an inner leg 58, an outer leg or tail 60 and a bridge portion 62 joining the legs. U-shaped terminating portion 56 of lower terminal 30b has an inner leg 64, an outer leg or tail 66 and a bridge portion 68 joining the legs. Inner legs 58 and 64 of the terminating portions of the upper and lower terminals may be located in recessed area 46 in rear terminating face 16 of connector housing 12.

Outer legs 60 and 66 of terminating portions 54 and 56, respectively, of upper and lower terminals 30a and 30b, respectively, define solder tails for the respective terminals. The solder tails project downwardly into holes 70 in printed circuit board 44 to ultimately be soldered to appropriate circuit traces in the holes.

Figure 4:
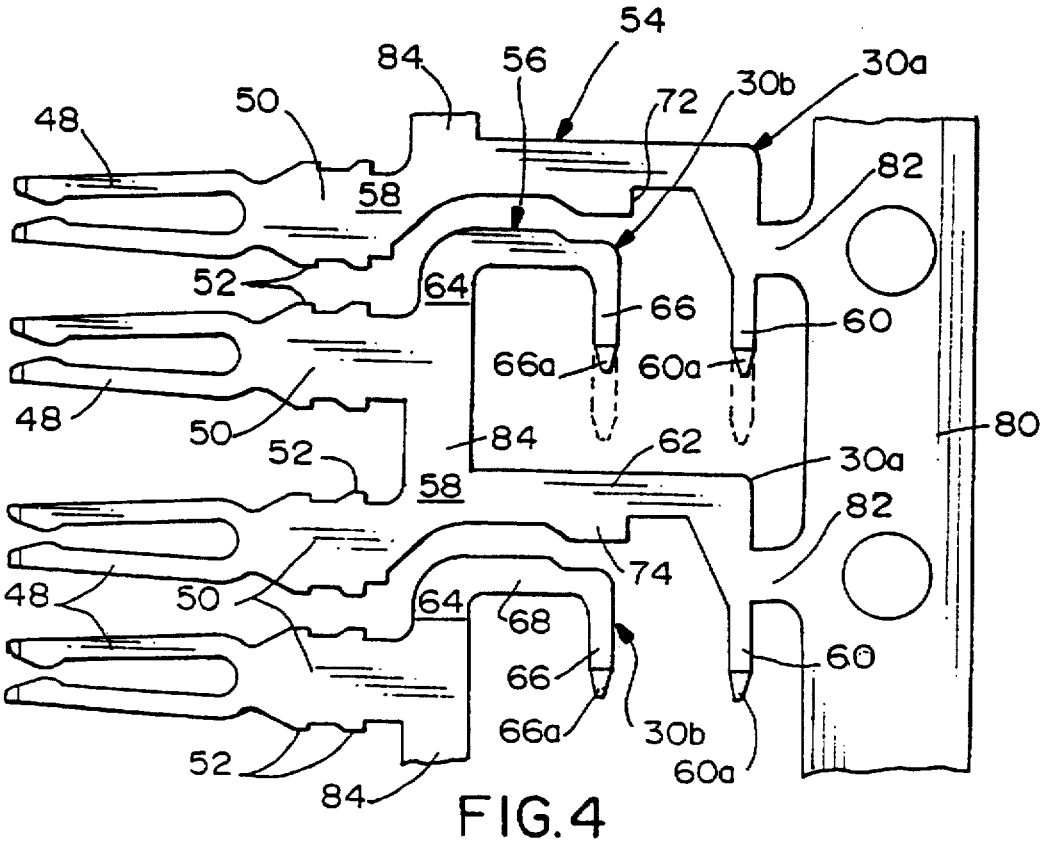
FIG. 4 is a plan view of two pairs of terminals as blanked from a sheet of metal material, but with the terminals still joined to a carrier strip of the sheet.

In practice, the length of solder tails 60 and 66 may be increased or reduced and may extend significantly downward past lower barbs 52 of terminal 30b, as shown in phantom in FIG. 4, so long as there is sufficient clearance between tips 60a and 66a of tails 60 and 66, respectively, and the top of bridge 62. This distance is affected by the length of web 84. This saves material during the blanking process of the terminals, as described hereinafter.

A shoulder 72 is formed by a tab 74; projecting downwardly from the underside of bridge portion 62 of upper terminal 30a to define a means against which the terminal can be pushed or inserted into passages 40 in connector housing 12. Insertion forces are directed against upper terminal 30a as indicated by arrow "A" and against lower terminal 30b as indicated by arrow "B" to insert the terminals into the passages of the connector housing by a "stitching" type of insertion process. Therefore, insertion forces are not applied to the delicate tail portions 60 and 66 of the terminals, thereby avoiding the possibility of damaging or misaligning those small, fragile elements of the terminals.

Lastly, FIG. 4 shows two pairs of terminals 30*a* and 30*b* as stamped from a blank of sheet metal material. It can be seen that terminals 30*a* still are joined to a carrier strip 80 by webs 82 which carry the terminals through the stamping operations. Terminal 30*b* of a first set of terminals is joined to terminal 30*a* of a second set of terminals by webs 84. Webs 82 and 84 eventually are severed so that the terminals can be stitched in pairs (see terminals 30*a* and 30*b* in FIG. 2) into passages 40 of connector housing 12 from rear terminating face 16 of the housing. FIG. 4 shows how closely the terminals are located in the sheet of metal material during fabrication. This disposition of the terminals is afforded by nesting the U-shaped terminating portion 56 of the lower terminal within the U-shaped terminating portion 54 of the upper terminals. Material is saved by closely spacing the pairs of terminals. As seen clearly in FIG. 4, the lower terminals 30*b* in each pair thereof are located quite closely to the upper terminals 30*a* of the next pair, joined only by small webs 84, to thereby minimize the amount of sheet metal material wasted between the pairs during blanking of the terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

an elongated dielectric housing adapted for mounting along an edge of a printed circuit board, a mounting portion of the housing adapted for mounting adjacent a top surface of the board and defining a seating plane of the connector, said housing having two rows of terminal-receiving passages, said passages being arranged in pairs of upper and lower passages along at least a portion of the housing, the passages in each pair being aligned in a plane generally perpendicular to said seating plane; and a plurality of aligned pairs of terminals, each pair being mounted in one of said pairs of passages of the housing and including an upper terminal and a lower terminal, said upper and lower terminals of each pair being aligned in a plane generally perpendicular to said seating plane, each terminal including a retention portion for securing the terminal within one of said passages, a forward mating portion for mating with a terminal of a complementary mating component, and a rear portion for termination with a circuit trace on the printed circuit board, said rear portion of each terminal having a generally inverted U-shape which defines an inner side portion, a downwardly directed outer leg, and a bridge portion between said inner side portion and outer leg, said bridge portion of each lower terminal having an uppermost perimeter located above a lowermost perimeter of the retention portion of the aligned upper terminal, said inner side portion, bridge portion, and at least a portion of the outer leg of each of said terminals being blanked from generally planar sheet metal material so as to have planar side surfaces in the plane of the sheet metal material and edges about said surfaces, said side surfaces having a substantially greater width dimension than said edges and being generally perpendicular to said seating plane, and said terminals each having their retention portion press fit within a respective one of said housing passages and their rear portion free of any over molded plastic.

2. The electrical connector of claim 1 in which said upper and lower terminals each are blanked in their entirety from sheet metal material so that the mating, retention, and rear portions of each terminal have co-planar sides generally perpendicular to the seating plane.

3. The electrical connector of claim 1 in which the rear portion of each upper terminal defines an undercut, and the rear portion of each lower terminal is nested within the undercut of the rear portion of the aligned upper terminal.

4. The electrical connector of claim 3 in which said undercut of each upper terminal is defined by the generally inverted generally U-shape of the rear portion.

5. The electrical connector of claim 1 in which said bridge portion of each terminal is connected between the upper ends of the inner side portion and outer leg of the rear portion.

6. The electrical connector of claim 1 in which the inner portion and outer leg of each lower terminal rear portion are generally parallel to each other.

7. The electrical connector of claim 1 further including a push shoulder formed on an underside of the rear portion of each upper terminal to facilitate insertion of the upper terminals into their respective passages.

8. The electrical connector of claim 7 wherein said push shoulder is generally aligned with the mating portion of said upper terminal.

9. The electrical connector of claim 1 wherein said seating plane is positioned above the centerline of the lower terminal-receiving passages.

10. The electrical connector of claim 8 wherein said push shoulder is generally adjacent a horizontal midpoint of said rear portion.

11. The electrical connector of claim 7 wherein said push shoulder is generally adjacent the outer leg of said lower terminal to provide access to said push shoulder from below and between the outer legs of said upper and lower terminals.

12. The electrical connector of claim 7 further comprising a push shoulder on a stamped edge of the inner side portion of said lower terminal facing the outer leg thereof.

13. The electrical connector of claim 12 wherein the push shoulder of said upper terminal is generally aligned with one of said upper passages and the push shoulder of said lower terminal is generally aligned with one of said lower passages.

14. The electrical connector of claim 1 wherein said inner side portion of each upper terminal is in the form of an upwardly directed inner leg.

15. The electrical connector of claim 14 wherein a top surface of each bridge portion is located above the mating portion of its respective terminal.

16. The electrical connector of claim 14 wherein the outer leg and the bridge portion of each terminal are spaced from the housing.

17. The electrical connector of claim 1 wherein said mating portion of each terminal has a pair of spaced apart resilient beams.

18. The electrical connector of claim 1 in which the retention portion of each terminal also is blanked from sheet metal so as to have planar side surfaces in the plane of the sheet metal material and generally perpendicular to the seating plane.

19. The electrical connector of claim 18 further comprising a push shoulder on a stamped edge of the inner side portion of said lower terminal facing the outer leg thereof.

20. The electrical connector of claim 19 wherein the push shoulder of said upper terminal is generally aligned with one of said upper passages and the push shoulder of said lower terminal is generally aligned with one of said lower passages.

21. The electrical connector of claim 1 in which the mating portion of each terminal also is blanked from said sheet metal material so as to have planar side surfaces in the plane of the sheet metal material and generally perpendicular to the seating plane.

22. The electrical connector of claim 1 in which the mating portion and retention portion of each terminal also are blanked from said sheet metal material so as to have planar side surfaces in the plane of said sheet metal material and generally perpendicular to said seating plane.

23. An electrical connector, comprising:

an elongated dielectric housing adapted for mounting along an edge of a printed circuit board, a mounting portion of the housing adapted for mounting adjacent a top surface of the board and defining a seating plane of the connector, said housing having two rows of terminal-receiving passages, said passages being arranged in pairs of upper and lower passages along at least a portion of the housing, the passages in each pair being aligned in a plane generally perpendicular to said seating plane; and a plurality of aligned pairs of terminals, each pair being mounted in one of said pairs of passages of the housing and including an upper terminal and a lower terminal, said upper and lower terminals of each pair being aligned in a plane generally perpendicular to said seating plane, each terminal including a retention portion for securing the terminal within one of said passages, a forward mating portion having a pair of spaced apart resilient beams for mating with a terminal of a complementary mating component, and a rear portion for termination with a circuit trace on the printed circuit board, said rear portion of each terminal having a generally inverted U-shape which defines an inner side portion, a downwardly directed outer leg, and a bridge portion between said inner side portion and outer leg, said bridge portion of each lower terminal having an uppermost perimeter located above a lowermost perimeter of the retention portion of the aligned upper terminal, said mating portion, retention portion, inner side portion, bridge portion, and at least a portion of the outer leg of each said terminal being blanked from generally planar sheet metal material so as to have planar side surfaces in the plane of the sheet metal material and edges about said surfaces, said side surfaces having a substantially greater width dimension than said edges and being generally perpendicular to said seating plane, said terminals each having their retention portion press fit within a respective one of said housing passages and their rear portion free of any over molded plastic, the rear portion of each upper terminal defining an undercut, and a portion of the rear portion of each lower terminal being nested within the undercut of the rear portion of the aligned upper terminal.

24. The electrical connector of claim 23 in which the inner side portion and outer leg of each lower terminal rear portion are generally parallel to each other.

25. The electrical connector of claim 23 further including a push shoulder formed on an underside of the bridge portion of each upper terminal to facilitate insertion of the upper terminals into their respective passages.

26. The electrical connector of claim 25 wherein said push shoulder is generally aligned with the mating portion of said upper terminal.

27. The electrical connector of claim 23 wherein said seating plane is positioned above the centerline of the lower terminal-receiving passages.

28. The electrical connector of claim 25 wherein said push shoulder is generally adjacent a horizontal midpoint of said bridge portion.

29. The electrical connector of claim 25 wherein said push shoulder is generally adjacent the outer leg of said lower terminal to provide access to said push shoulder from below and between the outer legs of said upper and lower terminals.

30. The electrical connector of claim 23 wherein a top surface of each bridge portion is located above the mating portion of its respective terminal.

31. The electrical connector of claim 30 wherein the outer leg and the bridge portion of each terminal are spaced from the housing.

32. The electrical connector of claim 23 wherein the outer leg of each terminal is unsupported by the housing.

33. An electrical connector, comprising:

an elongated dielectric housing adapted for mounting along an edge of a printed circuit board, a mounting portion of the housing adapted for mounting adjacent a top surface of the board and defining a seating plane of the connector, said housing having two rows of terminal-receiving passages, said passages being arranged in pairs of upper and lower passages along at least a portion of the housing, the passages in each pair being aligned in a plane generally perpendicular to said seating plane; and a plurality of aligned pairs of terminals, each pair being mounted in one of said pairs of passages of the housing and including an upper terminal and a lower terminal, said upper and lower terminals of each pair being aligned in a plane generally perpendicular to said seating plane, each terminal including a retention portion for securing the terminal within one of said passages with a press-fit, a forward mating for mating with a terminal of a complementary mating component, and a rear portion for termination with a circuit trace on the printed circuit board, the rear portions of said terminals being blanked from generally planar sheet metal material so as to have planar side surfaces and edges about said surfaces, said side surfaces having a substantially greater width dimension than said edges and being generally perpendicular to said seating plane, said rear portion of each lower terminal having a generally inverted U-shape which defines an upwardly directed inner leg, a downwardly directed outer leg, and a bridge portion extending between said inner and outer legs, said bridge portion of each lower terminal having an uppermost perimeter located above a lowermost perimeter of the retention portion of the aligned upper terminal, and the rear portion of each upper terminal being formed with a push shoulder on an underside thereof for facilitating insertion of the upper terminals into their respective passages.

34. An electrical connector, comprising:

an elongated dielectric housing adapted for mounting along an edge of a printed circuit board, a mounting portion of the housing adapted for mounting adjacent a top surface of the board and defining a seating plane of the connector, said housing having two rows of terminal-receiving passages, said passages being arranged in pairs of upper and lower passages along at least a portion of the housing, the passages in each pair being aligned in a plane generally perpendicular to said seating plane; and a plurality of aligned pairs of terminals, each pair being mounted in one of said pairs of passages of the housing and including an upper terminal and a lower terminal, said upper and lower terminals of each pair being aligned in a plane generally perpendicular to said seating plane, each terminal including a retention portion for securing the terminal within one of said passages with a press-fit, a forward mating portion having a pair of spaced apart resilient beams for mating with a terminal of a complementary mating component, and a rear portion for termination with a circuit trace on the printed circuit board, said upper and lower terminals each being stamped from generally planar sheet metal material so that the mating, retention and rear portions of each terminal have co-planar side surfaces generally perpendicular to the mating plane and edges about said surfaces, said side surfaces having a substantially greater width dimension than said edges and being generally perpendicular to said seating plane, said rear portion of each terminal having a generally inverted U-shape which defines an upwardly directed inner leg, a downwardly directed outer leg, and a bridge portion extending between said inner and outer legs, said bridge portion of each lower terminal having art uppermost perimeter located above a lowermost perimeter of the retention portion of the aligned upper terminal, the rear portion of each upper terminal defining an undercut, a portion of the rear portion of each lower terminal being nested within the undercut of the rear portion of the aligned upper terminal, and the rear portion of each upper terminal being formed with a push shoulder on an underside thereof for facilitating insertion of the upper terminals into their respective passages.

* * * * *